United States Patent [19]

Pattarozzi

[11] 4,414,789

[45] Nov. 15, 1983

[54] APPARATUS FOR TRANSFORMING BLANKS INTO CORRESPONDING CONTAINERS BY PARALLELEPIPED SHAPE

[75] Inventor: Domenico Pattarozzi, San Lazzaro di Savena, Italy

[73] Assignee: B.S.P. Packaging Systems Di Pattarozzi D. & C. S.A.S., Ozzano Emilia, Italy

[21] Appl. No.: 243,808

[22] Filed: Mar. 16, 1981

[30] Foreign Application Priority Data

Mar. 18, 1980 [IT] Italy ..... 3358 A/80

[51] Int. Cl.[3] ..... B65B 43/24

[52] U.S. Cl. ..... 53/566; 53/374; 493/316

[58] Field of Search ..... 53/566, 374; 493/309, 493/315–317

[56] References Cited

U.S. PATENT DOCUMENTS 3,420,037 1/1969 Villemure ..... 53/566
3,476,023 11/1969 Fuller et al. ..... 93/39.1
3,956,868 5/1976 Ganz ..... 53/566 X
4,067,172 1/1978 Paules ..... 53/53
4,160,406 7/1979 Nowacki ..... 93/36.3

*Primary Examiner*—A. J. Heinz
*Attorney, Agent, or Firm*—Fleit, Jacobson, Cohn & Price

[57] ABSTRACT

Disclosed herein is an apparatus that comprises grasping suction pads designed to grip the bottom blank in a pile and, in cooperation first of all with second grasping suction pads, then with an intermediate arm, and finally with third grasping suction pads, to open the blank while it is held stably in a forming station through the contemporaneous gripping of two lateral walls that are maintained orthogonal by the first and second grasping suction pads. At the forming station, first folding devices attend to the folding of the flaps that define the bottom of the container, subsequently to which a pile of articles is placed inside the container. Once this has been done, second folding devices attend to the folding of the flaps that define the cover of the container. Then with the synchronous movement of two frames, each of which is provided with three of the four folding members belonging both to the first and second folding devices, the transfer of the container takes place towards the movement devices connected to a banding group.

8 Claims, 15 Drawing Figures

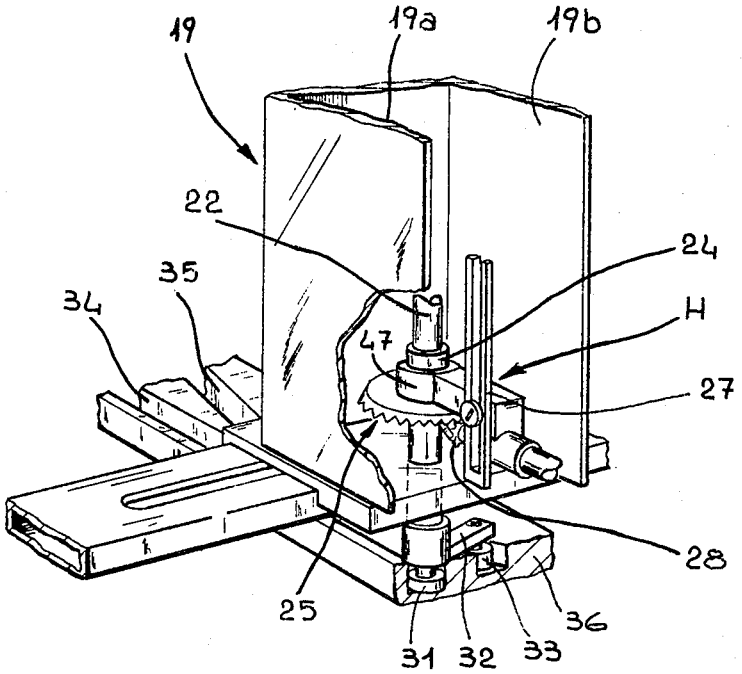
FIG11
FIG13
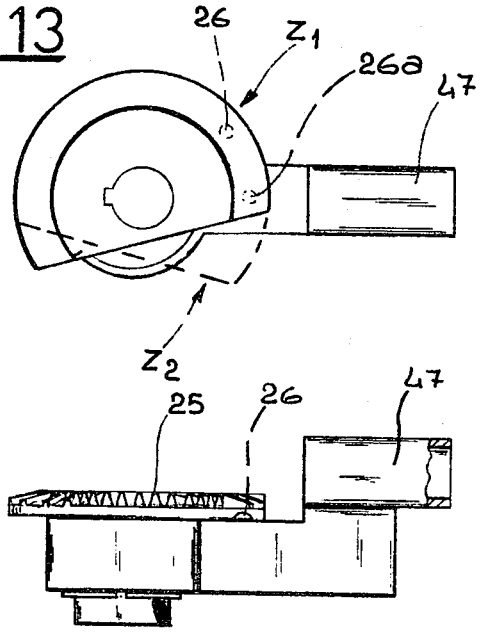
FIG14
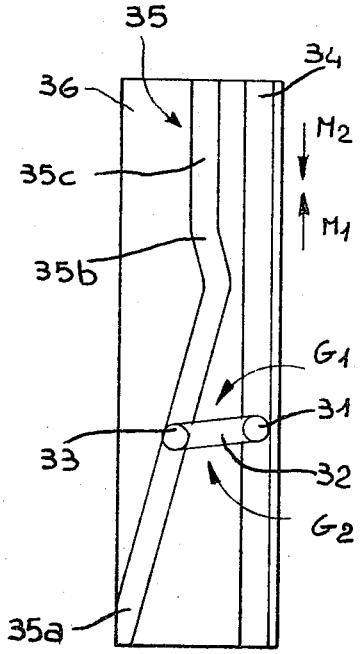
FIG12

APPARATUS FOR TRANSFORMING BLANKS INTO CORRESPONDING CONTAINERS BY PARALLELEPIPED SHAPE

BACKGROUND OF THE INVENTION

The invention relates to an apparatus for transforming blanks into corresponding containers of parallelepiped shape, the said blanks being provided with creasings and slits that define the lateral walls, the base flaps and the cover of corresponding containers. Each blank is constituted by two superposed sheets joined one to the other, at two opposite extremities, by two creasings that define the edges of the lateral walls of the corresponding container. Each sheet has, moreover, in the center along an intermediate line, parallel to the aforementioned extremities, a creasing that defines the edge between two lateral walls of the corresponding container.

DESCRIPTION OF THE PRIOR ART

Apparatuses destined for the transformation of blanks into corresponding containers of parallelepiped shape are already known.

In a first solution, each blank is removed, by means of a withdrawal device, from a stack of horizontal axis blanks housed in a magazine, and through a vertical movement, is placed on a guide that constitutes the station for the infeeding of the blanks. In order to ensure the verticalness of the blank, it is kept in abutment on a vertical platform, using springs.

Subsequently, the blank is sent by a pusher member to a first folding station equipped with fixed suction pads connected to suction means that lock onto one lateral wall of the blank.

Using movable suction pads carried "flag" fashion by a rotating frame, a hold is exerted on the lateral wall of the blank opposite the one held stably by the said fixed suction pads. The "flag" rotation of the said frame causes the blank to open up and to adopt a tubular conformation of rectangular section. Contemporaneously with the opening of the blank, a folder member is used to fold at 90° two opposite flaps in the base of the container. Then, with the aid of a further pusher member, the container, so formed, is sent to a further folding station where, using one or more folder members, the two remaining flaps of the base are folded at 90°.

In a constructionally more sophisticated solution, the bottom of the magazine coincides with the first folding station. In the said case, the function of the fixed suction pads is carried out by means that clamp the border of the two opposite flaps, connected to the magazine.

Both solutions outlined above require apparatus of notable dimensions and limited operating speeds. Furthermore, the frame that rotates "flag" fashion is constituted by a combination of mutually articulated arms and levers in order to achieve the optimum opening of the blank and to match the various dimensions of the latter. All this causes constructional complications and the need for frequent maintenance.

The considerable problem that arises with the solutions considered above and with other technical methods not mentioned herein for reasons of brevity, is that generally the formation of the base of the container, the insertion into the container of the pile of articles, and the formation of the cover of the container take place in three stations separate from one another. This necessitates the apparatus destined to perform the aforementioned operations being of a considerable overall size and its having a imited operating speed.

SUMMARY OF THE INVENTION

The object of the invention is to make available an apparatus for transforming blanks into corresponding containers of parallelepiped shape, the conformation of which is such that it be possible to achieve at the station where each blank is transformed into a corresponding tubular container of rectangular section, the folding of the flaps that define the base of the container, the insertion into the container, thus formed, of an orderly pile of articles and, finally, the folding of the flaps that define the cover of the said container, with all this being done at high operating speed without detriment to the functional aspects of the said apparatus (namely an absence of rejects).

A further object of the invention is to make available an apparatus which, once each individual container has been filled and closed, attends to the sending forward of the container towards the movement devices connected to a banding group provided to lock the flaps of the base and cover of the said container.

The aforementioned objects are all attained with the apparatus according to the invention for transforming blanks into corresponding tubular containers of parallelepiped shape, each of the said blanks being constituted by two superposed sheets provided with longitudinal creasings that define the lateral walls of the corresponding container, as well as with transverse creasings and longitudinal slits, the latter being aligned with the longitudinal creasings that define the flaps of the base and the cover of the said container; the said apparatus comprising a vertical magazine, destined to accept a stack of the said blanks, open low down and provided, in the region of the base, with means for supporting the said stack; the said apparatus being characterized in that it comprises: a carriage placed on the base of the said magazine and movable, parallel to the axis of the magazine, between three consecutive stations, namely, one for removing the blank at the bottom of the said stack, one for forming the said blank into a corresponding parallelepiped container and for filling it, and one for releasing the filled container; first and second suction operated grasping means, the former exerting an effect on the wall of the lower sheet of the blank destined to remain parallel with the base of the magazine, and the latter exerting an effect on the remaining lateral wall of the lower sheet for the time it takes to part the said sheet from the aforementioned means that support the stack; a first and a second arm pivotally connected one to the other at one common extremity and, at the other, to the carriage and the support structure of the machine, respectively, the former intended to establish contact with the lateral wall held by the second grasping means in order to open the blank, in conjunction with the first grasping means, as the carriage travels from the withdrawal station to the forming station, and the latter constituted by two parts placed at an angle, the first of which, that is to say, the part articulated to the first arm, being positioned, when the carriage is in the forming station, both perpendicularly to the lateral wall held by the first grasping means and in a position at the side of the remaining wall of the lower sheet; third suction operated grasping means, carried by the said first part of the second arm, actuated one moment before the said carriage enters the container forming station; first folding means, that work on the opened blank positioned in the container forming station, provided to fold, at successive times, a first base flap of the container perpendicular to the lateral wall held by the first grasping means, a second flap symmetrical with the first flap and, synchronously, the remaining flaps; means for the insertion into the aforementioned opened blank provided with its base, of an orderly pile of articles; second folding means, that work on the said opened blank containing the said pile of articles, provided to fold the cover flaps of the container made out of the said blank, in the same sequence of folding operations as for the base flaps; and means, actuated concurrently with the disengagement of the said first and third grasping means and with the displacement of the said carriage towards the said container releasing station, provided to transfer the said filled container towards the movement devices of a banding group.

Both the said first and second folding means comprise: a first arm that rotates with respect to an axis parallel to the motion of the carriage, movable between two extreme positions, namely, a position where there is no contact with the space occupied by the opened blank positioned in the container forming and filling station, and a position where contact is established with a corresponding first flap perpendicular to the lateral wall of the opened blank held by the first grasping means, with a rotation through at least 90° of the said flap towards the inside of the blank; a frame, that slides guided in a direction perpendicular to the motion of the carriage, subjected to first drive means that define for it, at a time not preceding the folding of the said first flap, a first advancement phase towards the opened blank, an eventual non-operative phase, a second advancement phase and a return phase; a movable assembly, supported rotatably by the said frame, carrying in the center a fixed folder member aligned with the line separating the two symmetrical flaps of the blank bilateral with respect to the first flap, in the closed position and supporting rotatably at each of its two extremities, a pin that carries eccentrically a corresponding folder arm; and drive, guide, locator and snap-in engagement means, all connected to the said assembly and defining for it an external position in which the relevant folder devices have no contact with the opened blank positioned in the container forming and filling station and, concurrently with the first advancement phase of the frame, an internal position of this in which the fixed folder member establishes contact with the second flap symmetrical with respect to the first flap, with a rotation of the said second flap through at least 90° towards the inside of the blank and, successively, the movement in counter-rotating directions of the said folder arms, with the remaining flaps being folded synchronously towards the inside of the blank until a predetermined minimum distance in between the said folder arms has been reached; the said drive, guide, locator and snap-in engagement means defining for the said assembly, concurrently with the second advancement phase of the frame, an intermediate position between the outside and the inside, with the said arms positioned at the minimum distance away one from the other, foreseen to limit the pressure applied on the respective flaps by the folder arms and the fixed folder member.

BRIEF DESCRIPTION OF THE DRAWINGS

Emphasis is given hereinafter to the characteristics of the invention, with reference to the accompanying tables of drawings, in which:

FIG. 11 illustrates, in a perspective view and in an enlarged scale, the detail A in FIG. 10;

FIG. 12 illustrates, in a front view, the detail H in FIG. 11;

FIG. 13 illustrates, in a plan view, the same detail as in FIG. 12, in two characteristic positions, one of which shown with continuous lines, and the other in dashes;

FIG. 14 illustrates, qualitatively, the conformation of the guides in respect of the said first folder devices;

DESCRIPTION OF THE PREFERRED EMBODIMENT

Figure 1:
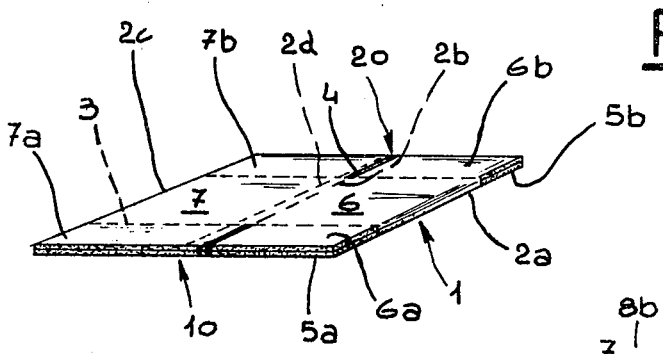
FIGS. 1 and 2 illustrate, in two perspective views, a blank in its flattened configuration, and in the configuration wherein it has become a container of rectangular section, respectively.
Figure 2:
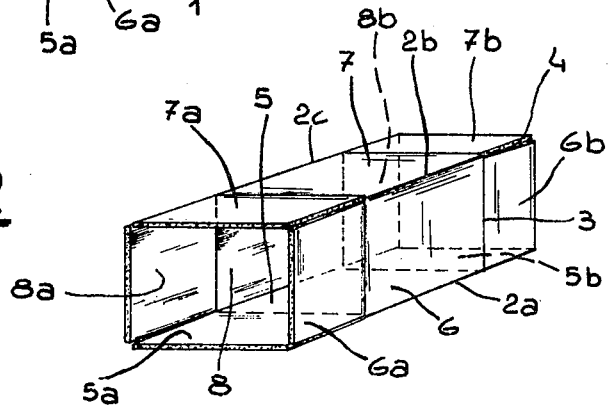
Figure 9:
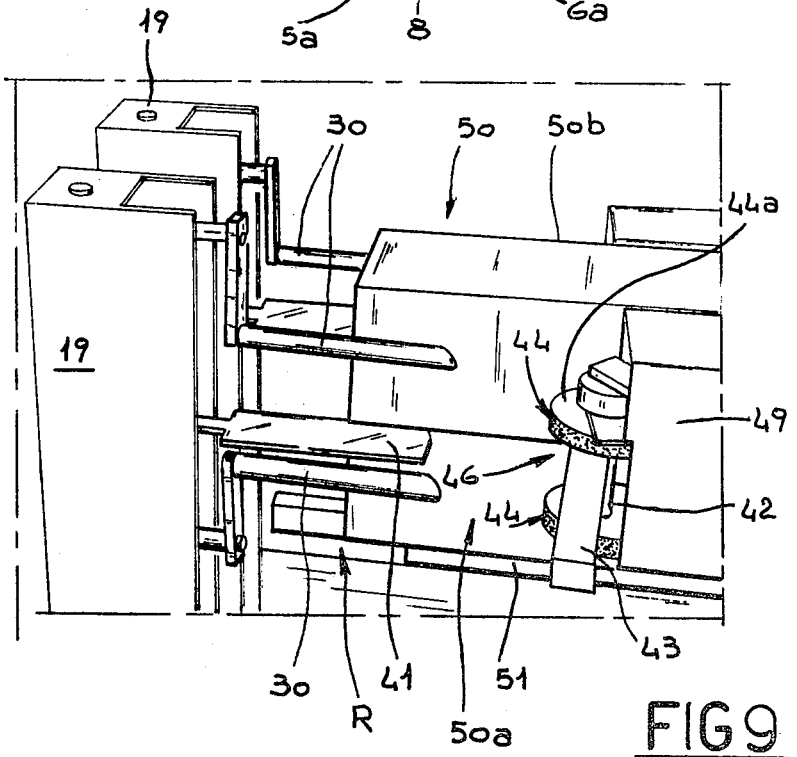
FIGS. 3, 4, 5, 6, 7, 8 and 9 illustrate the various phases for transforming a blank into a corresponding container of parallelepiped shape.

With reference to FIGS. 1 and 2, shown at (1) there is a blank (for example, made of corrugated board) provided with longitudinal creasings **(2*a*), (2*b*), (2*c*) and (2*d*), transverse creasings (3) and slits (4), the latter aligned with the corresponding longitudinal creasings, for the purpose of defining the lateral walls (5), (6), (7) and (8) and the flaps (5*a*), (5*b*), (6*a*), (6*b*), (7*a*), (7*b*), (8*a*) and (8*b*) of a corresponding container (50). The blank, in the flattened configuration illustrated in FIG. 1, is constituted by two superposed sheets (10) and (20), connected one to the other by the creasings (2*a*) and (2*c*) (FIG. 1**).

The blanks, in their flattened configuration, are stacked in a suitable vertical magazine (9), the lower part of which is provided with means of support (11) (of a known type) destined to sustain the stack of the said blanks (12). The said means (11) only allow the blank right at the bottom of the said stack (12) to be withdrawn, and this provided suitable withdrawal means are used. The said withdrawal means are constituted by suction pads (14) (first suction operated grasping means) and by suction pads (13) (second suction operated grasping means) connected, via flexible tubes **(14*a*) and (13*a*), respectively, to appropriate suction means. The said suction pads (14) and (13) are supported by a cariage (15)** positioned underneath the base of the magazine and movable vertically between three consecutive stations, namely, a station for the withdrawal of the bottom blank, a station for forming and filling the containers, and a station for releasing the filled containers, shown at (P), (F) and (R), respectively.

The suction pads (14) are intended to adhere to the lateral wall (5) destined to remain parallel with the base of the magazine, while the suction pads (13) are intended to adhere to the wall (8) of the lower sheet (10). The said adherence lasts for sufficient time to effect the release of the aforementioned lower sheet (10) from the means of support (11) of the magazine. The latter situation can be seen clearly in FIGS. 3 and 4 in which the suction pads (13) are attached to the wall (8) and are non-operative, respectively.

Figure 3:
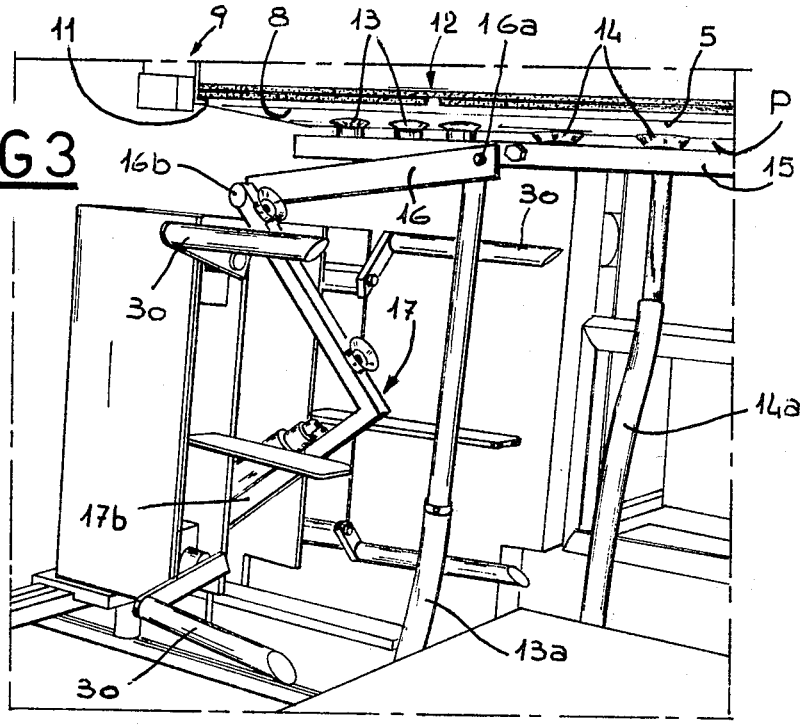
Figure 4:
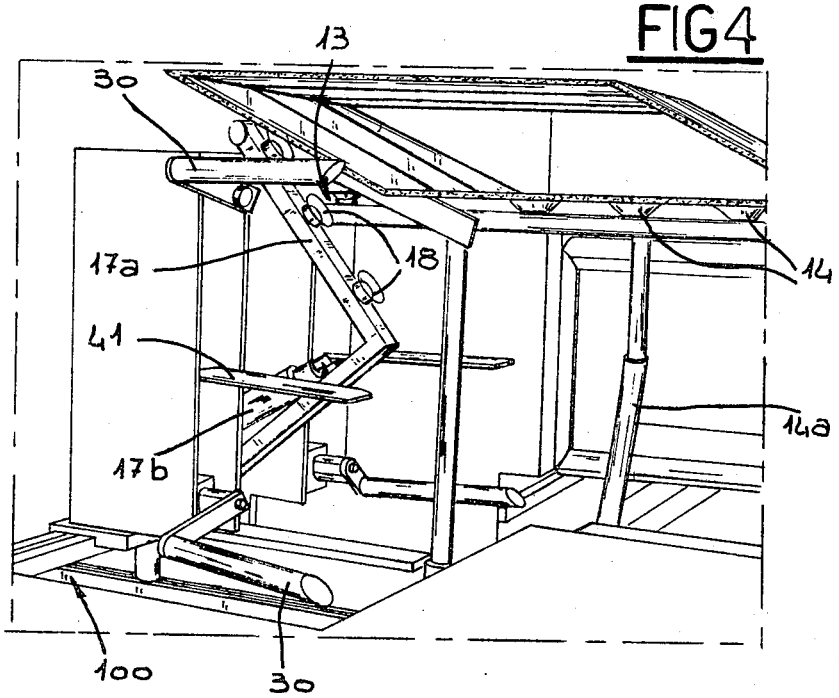

To the carriage (15) is pivotally connected at (16*a*), the extremity of a first arm (16), the other extremity of which is pivoted at (16*b*) to a second arm (17) constituted by a first section (17*a*) and a second section (17*b*) placed at 90° one from the other as shown in FIGS. 3 and 4. The section (17*b*) is pivotally connected to the structure (100) of the apparatus under consideration. The dimensions of the arm (16) and of the sections (17*a*) and (17*b*), as also the way in which they are positioned with respect to the carriage (15), are so calculated as to cause predetermined action on the blank (1) to be taken while it is being opened. The arm (16), with the carriage (15) at the station (P), is, in fact, positioned beneath the wall (8) (FIG. 3). Just as soon as the lower sheet (10) is dragged downwards (FIG. 4) and the grip applied by the suction pads (13) on the wall (8) ceases, the arm (16) establishes contact with the said wall (8). Because of the contemporaneous downward dragging action of the wall (5) held by the suction pads (14), this causes the blank (1) to be opened. The dimensions of the arm (16) and of the sections (17*a*) and (17*b*) of the arm (17) are, as stated above, such that the section (17*a*) (that is to say, the one pivoted to the arm (16)) is placed, when the carriage (15) is at the station (F), perpendicularly to the wall (5), in a position at the side of the wall (8). This is of the utmost importance since the section (17*a*) is provided with suction pads (18) (third suction operated grasping means) which come into operation a moment before the carriage (15) enters the station (F).

It can be seen from the foregoing that at the station (F), the blank (1) adopts a tubular configuration (FIGS. 5 and 6) of certainly rectangular section due to the fact that the action of the suction pads (14) and (18) on the walls (5) and (8), respectively, ensures their perpendicularlity. The said situation continues, as will be seen below, during the formation of the base of the container (50), during the insertion therein of an orderly stack of articles, and during the formation of the cover of the said container. The folding of the flaps (5*a*), (6*a*), (7*a*) and (8*a*), for the purpose of forming the base (50*a*) of the container (50), is achieved by first folding means. Similarly, the folding of the flaps (5*b*), (6*b*), (7*b*) and (8*b*), for the purpose of defining the cover (50*b*) of the container, is achieved by corresponding second folding means. The said first and second folding means are identical in every respect, the sole distinguishing factor being their operating duration, as will be seen hereinafter when consideration is given to the phase graph.

Thus, in the text that follows, a description will only be given in respect of the first folding means, namely those destined to form the base (50*a*).

Figure 10:
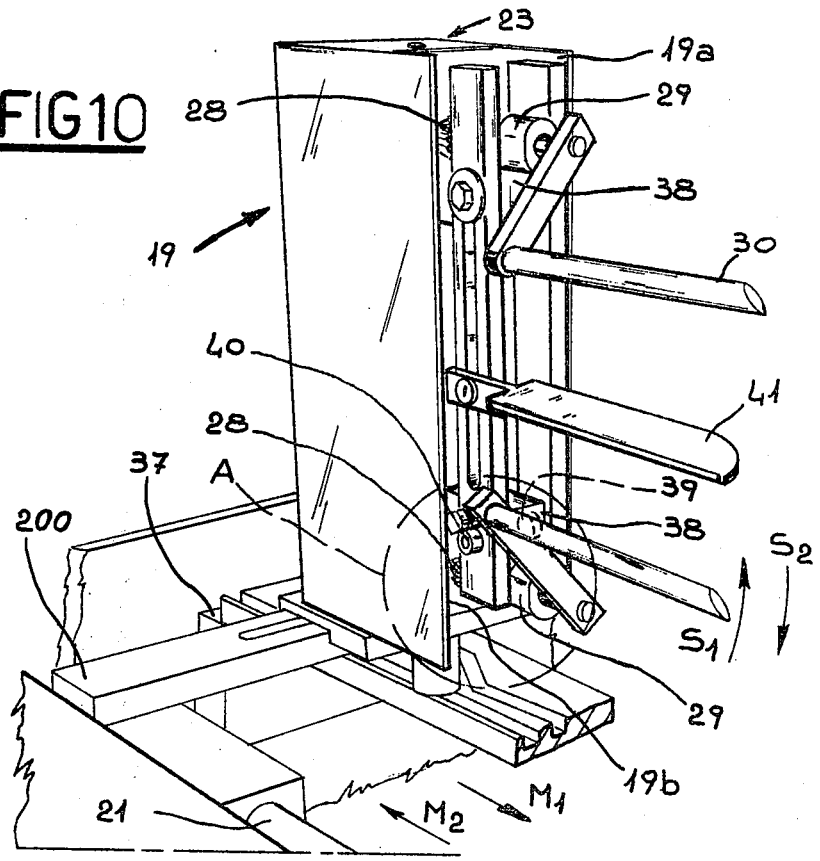
FIG. 10 illustrates, in a perspective view, the first folder devices with certain parts removed in order that others may be rendered more prominent.

With particular reference to FIG. 10, at (19) there is a frame locked in a removable fashion, through known means, to a transverse bar 200 that slides longitudinally on corresponding guide bars (21). The movement of the bar (21) in the directions ($M_1$) and ($M_2$) is achieved through non-illustrated mechanism of a known type which creates a succession of phases, more about which will be said when reference is made to the phase graph. The frame (19) supports rotatably, through support and guide means (32) of a known type, a vertical shaft (22) on which are keyed two bushes (24), that is to say, an upper bush and a lower bush. The said upper bush is provided with a sector gear (25), and the lower bush also has a sector gear (25) which, however, points downwards.

The shaft (22) supports rotatably two sleeves (47) to which are fastened a movable assembly (27). Each sleeve (47) is locked in a removable fashion to a corresponding bush (24) at the side free from the sector gear. The said removable form of locking is accomplished by providing the sleeve (47) with a coupling device (constituted by a ball (26) subjected to non-illustrated elastic means) which is snap inserted into one or the other of two housings (26*a*) and (26*b*) provided in the said bush (24). In this way, with respect to the latter, the sleeve (47) is able to adopt two characteristic configurations shown at ($Z_1$) and ($Z_2$) with a continuous line and dashes, respectively, in FIG. 13.

The lower part of the shaft (22) is provided with a roller (31) that slides inside a rectilineal guide (34) made in a longitudinal rod (36). Immediately overhead of the roller (31), the shaft (22) has fixedly mounted on it an arm (32) whose other extremity is provided with a roller (33) that slides in a guide (35) in the form of a broken line, made in the said rod (36). The qualitative aspect of the said guide (35) is illustrated in FIG. 14 and the reason for this particular choice will be made clear hereinafter.

The movable assembly (27), which is provided at the front with an abutment (38), supports rotatably two pins (29), each of which keyed at one side to a bevel gear (28). Each gear (28) meshes with a corresponding sector gear (25), and each pin (29) is connected eccentrically, at the other extremity, to a corresponding folder arm (30), more about which will be said below. The said movable assembly (27) is provided, on opposite sides, with locator members (39) and (40) destined to go flush up against the corresponding inner walls (19*a*) and (19*b*) of the frame (19). Furthermore, the movable assembly (27) has locked to it a fixed, horizontal, folder member that is equidistant from the pins (29).

In order to position the frame (19) transversely, it is necessary to release it from the bar 200, then to select the required position (whicb is not obstructed by the presence of the longitudinal rod (36) since the latter slides freely on corresponding transverse guide bars (37)) and to then lock the frame (19) to the bar 200 again.

At (43) there is a folder member carried by a shaft (42) parallel to the motion of the carriage (15). The said shaft is sustained rotatably by the support structure (49) of a banding group (46) of a known type. Furthermore, the said shaft (42) is coaxial with the intermediate rollers (44*a*) of the movement device (44) of the banding group (46).

A description will now be given of the operation of the apparatus according to the invention, with particular reference to the phase graph in FIG. 15.

Shown at (110) in the said graph are the displacements of the carriage (15). The upward sloping lines represent the displacements downwards of the carriage, and the downward sloping lines, the displacements upwards thereof.

The operation of the suction pads (14) is shown at (120), and that of the suction pads (13), at (130). At (140) there is the action taken by the suction pads (13) on the wall (8); at (150) the operation of the suction pads (18); at (160) the operation of the rotating folder member (43); at (170) the longitudinal displacements of the frame (19), more precisely the upward sloping lines in the graph referring to the direction ($M_1$), and the downward sloping lines to the direction ($M_2$); at (180) are shown the rotations of the movable assembly (27), more precisely the upward sloping lines in the graph referring to the rotation of the assembly in the direction ($S_1$), and the downward sloping lines to the rotation in the direction ($S_2$); at (190) is shown the action taken by the fixed folder member (41); and at (200*a*) and (200*b*) the rotations of the arm (30) of the first folding means in the directions ($C_1$) and ($C_2$), in the initial part of the graph, and in the opposite direction in the distal part thereof.

Figure 15:
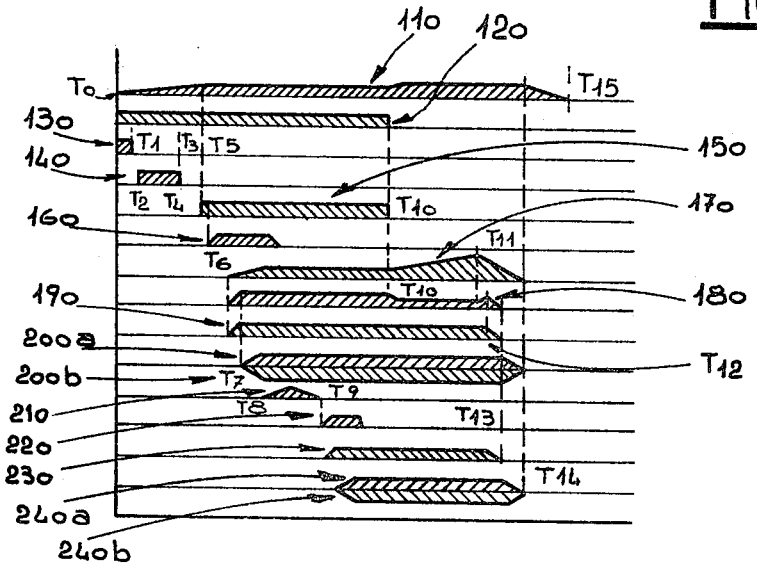
FIG. 15 illustrates, qualitatively, a phase graph in respect of the apparatus in question.

Again with reference to the phase graph in FIG. 15, shown qualitatively at (210) is the insertion of a stack of articles into the container; then at (200), (230), (240*a*) and (240*b*) is shown the action taken by the folder members of the second folding means, the behaviour of which is similar to that of the folder members shown at (160), (190), (200*a*) and (200*b*).

In the configuration illustrated in FIG. 3, the carriage (15) is at the station (P); the frame (19) is at a standstill and the movable assembly (27) is in the position defined by the locator member (40) abutting against the wall (19*a*). The fixed folder member (41). in the said situation, is placed as shown in FIG. 3, and the arms (30) are positioned again as shown in FIG. 3.

At the moment ($T_o$) the operation takes place of the suction pads (13) and (14) and the downward movement of the carriage (15) commences. While the said carriage moves downwards, moment ($T_1$), the suction pads (13) cease operating and subsequently, moment ($T_2$), the arm (16) establishes contact with the wall (8) and continues to do so until the moment ($T_3$). At the moment ($T_4$) the action of the suction pads (18) ceases, and at the moment ($T_5$) the carriage (15) arrives at the station (F). In this way a tubular container of rectangular section is formed.

The passage of the blank from the station (P) to the station (F) is not hindered by the arms (30) or by the folder members (41) and (43) which are placed as shown in FIGS. 3 and 4. At the moment ($T_5$), the operation takes place of the folder member (43) and this folds the flap (6*a*) at a right angle. With the folder member (43) in the aforementioned position, the traversing movement, moment ($T_6$), commences of the frame (19) in the direction ($M_1$). The engagement of the roller (33) with the first part (35*a*) of the guide (35) compels the shaft (22) to rotate in the direction ($G_1$). The said rotation, because of the ball (26) being snap inserted into the housing (26*a*), causes the movable assembly (27) to rotate in the direction ($S_1$). The said rotation of the movable assembly ceases once the locator member (39) comes flush up against the surface (19*b*). The rotation of the assembly (27) in the direction ($S_1$) is shown in the graph at (180) (FIG. 15-section ($T_6$)-($T_7$)).

Figure 5:
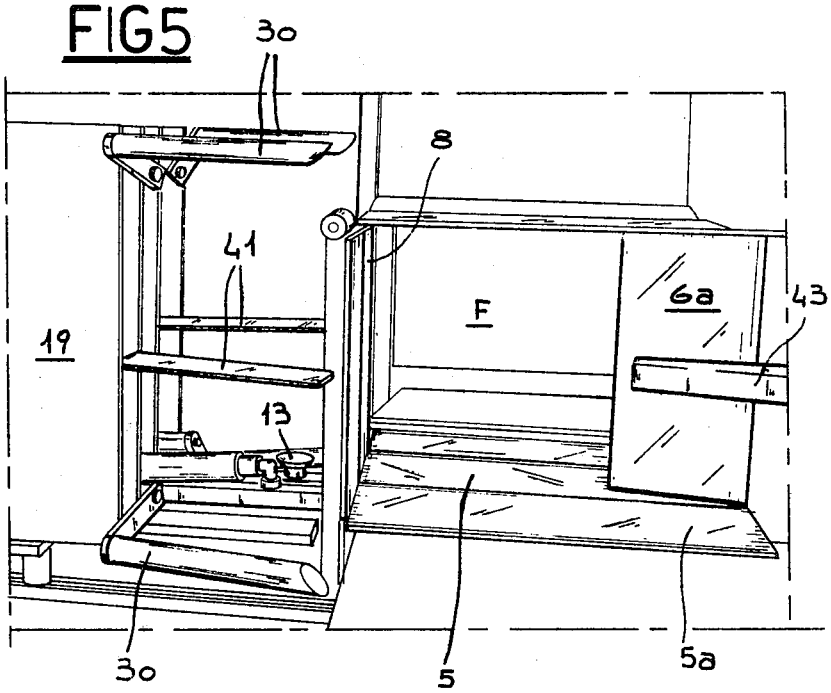
Figure 6:
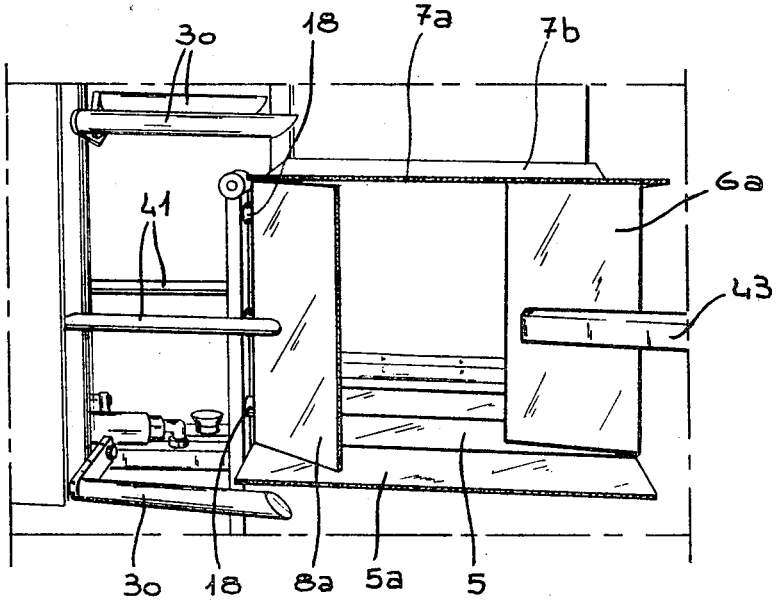

The fixed folder member (41) (which is positioned in the same plane as the line separating the flaps (7*a*) and (5*a*), placed in their closed position) can now, on account of the traversing movement of the frame (19) in the direction ($M_1$), intercept the corresponding flap (8*a*), with the consequential folding of this (FIG. 5).

Figure 7:
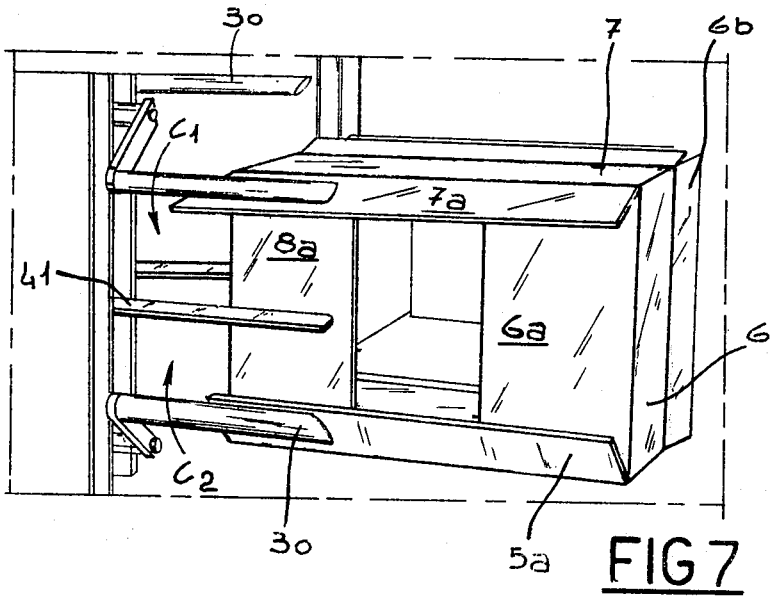

At the moment ($T_7$), as will be recalled, the rotation of the movable assembly in the direction ($S_1$) ceases. The continuation of the rotation of the shaft (22) in the direction ($G_1$) (due to the engagement of the roller (33) in the part (35*a*) of the guide (35)) causes the ball (26) to be released from the housing (26*a*). The said situation causes the sector gears (25) to slide with respect to the movable assembly (27) and, in this way, the rotation occurs to the bevel gears (28) with thus the rotation of the arms (30) (in the counter-rotating directions ($C_1$) and ($C_2$)) which intercept the flaps (7*a*) and (5*a*) (FIG. 7). The said interception obviously takes place once the flap (8*a*) has been folded inwards at a right angle. The said rotation stops when the said flaps (7*a*) and (5*a*) (FIG. 8) have been folded almost completely. Naturally, at a time preceding the interception of the arms (30) with the corresponding flaps, the folder member (43) has been returned to its non-operative position.

Figure 8:
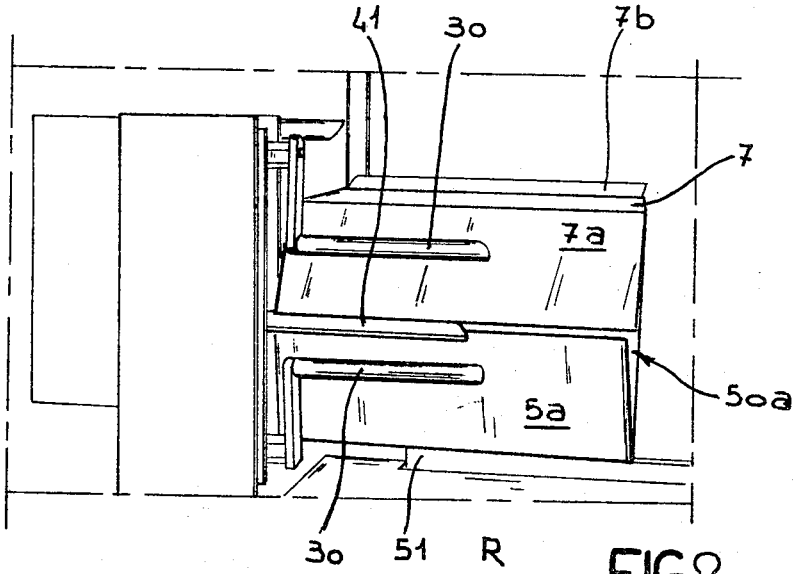

It is apparent from FIG. 8 that the flaps (7*a*) and (5*a*) are not fully folded but that pressure is exerted on them by the said arms. Likewise, the folder member (41) exerts suitable pressure on the flap (8*a*). At the moment ($T_8$), the folding of the flaps (7*a*) and (5*a*) ceases, and at this juncture the insertion into the container, thus formed, of an orderly stack of articles (not shown in the drawings) is possible. The said insertion takes place from the moment ($T_8$) to the moment ($T_9$).

Once the stack has been inserted, the second folding means come into operation and attend to the formation of the cover of the container. The said operations are shown qualitatively in the graph at (200), (230), (240*a*) and (240*b*) since the said second folding means are constituted by the same folding means already described earlier on. The formation of the cover terminates at the moment ($T_{10}$).

At this point, the problem presents itself of passing the container, formed and filled as described above, on towards the movement devices (44) of the banding group (46). At the moment ($T_{10}$) various things happen almost contemporaneously. The suction pads (13) and (18), in fact, cease operating and thus the container (50) rests on the underneath guides (51) that run towards the inlet to the said devices (44). Furthermore, the carriage (15) is lowered further in order to travel towards a releasing station (R) (this is to prevent any friction between the suction pads (13) and the container (50)). Again at the moment ($T_{10}$), the frame (19) starts to move anew in the direction ($M_1$). The said movement, because of the engagement of the roller (33) with the part (35*b*) of the guide (35), causes the rotation of the shaft (22) in the direction ($G_2$). The said rotation compels the movable assembly (27) to rotate in the direction ($S_2$) until the said assembly is carried into an intermediate position between the positions defined by the the locator members (39) and (40) abutting with the walls (19*a*) and (19*b*), respectively. The partial rotation of the movable assembly in the direction ($S_2$) ceases at the moment ($\overline{T}_{10}$). This causes a notable decrease in the pressure applied by the said rotating folder arms and by the said fixed folder members on the corresponding pre-folded flaps.

The movement of both frames (19) (that is to say, in respect of the first and second folding means) causes, a moment after ($\overline{T}_{10}$), the front abutments (38) of these to go flush up against the lateral wall (8). Thus the container is obliged to slide on the guides (51) until it is firmly in the grasp of the movement devices (44) and is subsequently subjected to the action of a banding group (46) (of a known type) whose function is to lock, one between the other, the flaps that define the base of the container (50), and those that define the cover thereof.

The said movement of the frames (19) ceases at the moment ($T_{11}$) and, at this stage, the frames travel in the reverse direction and return to their non-operative position in the direction ($M_2$). The movement of each frame (19) in the direction ($M_2$) causes the corresponding movable assembly (27) to rotate, first of all, in the direction ($S_1$) (ceasing to do so at the moment ($T_{12}$)) and, subsequently, to rotate in the direction ($S_2$) up until the time when the locator member (40) goes flush up against the wall (19*b*) (moment ($T_{13}$)). At this juncture, the rotation commences of the arms (30) in the opposite counter-rotating directions to the said directions ($C_1$) and ($C_2$); this ceases at the moment ($T_{14}$). The return of the carriage (15) (moment ($T_{15}$)) to the withdrawal station (P) allows a fresh cycle, identical to the previous one, to be commenced.

It is understood that the foregoing description has been given purely as an unlimited example and that modifications of a practical and technical nature may be made to the constructional details of the apparatus without in any way deviating from the technical solution described above and claimed hereunder.

What is claimed is:

1. Apparatus for transforming blanks into corresponding containers of parallelepiped shape, each of the said blanks being constituted by two superposed sheets provided with longitudinal creasings that define lateral walls of the corresponding container, as well as with transverse creasings and longitudinal slits, the latter being aligned with the longitudinal creasings so that the transverse creasings define flaps of the base and the cover of the said container, said apparatus comprising:

a magazine for holding a vertical stack of said blanks, said magazine having an open lower portion and including means for supporting the bottom of said stack;

a support structure for said magazine;

a carriage supported below a base of said magazine for movement in a downward direction parallel to a vertical axis of the magazine, between three consecutive stations, namely, a first station for removing the blank at the bottom of the said stack, a second station for forming the blank into a corresponding parallelepiped container and for filling it, and a third station for releasing the filled container;

means for moving said carriage between said stations;

first and second suction operated grasping means carried by said carriage, said first grasping means grasping a first portion of the wall of the lower sheet of the blank that remains parallel with the base of the magazine, and said second grasping means grasping a second portion of the wall of the lower sheet that subsequently forms a lateral wall of the container for removing said blank from said means for supporting the stack;

a first and a second arm pivotally connected one to the other at one common extremity and, at the other, to said carriage and said support structure, respectively, said first arm being positionable to contact the lateral wall held by the second grasping means in order to open the blank, in conjunction with the first grasping means, as the carriage travels from the first station to the second station, and said second arm having two parts placed at an angle, the first part being articulated to the first arm and being positioned, when the carriage is in the second station, both perpendicular to the lateral wall held by the first grasping means and in a position at the side of the remaining wall of the lower sheet;

third suction operated grasping means for grasping a lateral wall of the container carried by the said first part of the second arm and being actuatable prior to said carriage entering the second station;

first folding means for working on the opened blank positioned in the second station, at successive times, to fold a first base flap of the container perpendicular to the lateral wall held by the first grasping means, a second flap symmetrical with the first flap and, synchronously, the remaining flaps;

means for inserting into the opened blank provided with its base an orderly pile of articles;

second folding means for working on the said opened blank containing the said pile of articles for folding the cover flaps of the container made out of the said blank in the same sequence of folding operations as for the base flaps; and means, actuated concurrently with disengagement of the said first and third grasping means and with the displacement of the said carriage towards the said third station, for transferring the said filled container towards movement devices of a banding group.

2. Apparatus according to claim 1, wherein said first and second folding means each comprises: a first arm that rotates with respect to an axis parallel to the movement direction of the carriage between two extreme positions, namely, a first position where there is no contact with the space occupied by the opened blank positioned in the container forming and filling station, and a second position where contact is established with a corresponding first flap perpendicular to the lateral wall of the opened blank held by the first grasping means, with a rotation through at least 90° of the said flap towards the inside of the blank; a frame, that slides guided in a direction perpendicular to the motion of the carriage, subjected to first drive means that define for it, at a time not preceding the folding of the said first flap, a first advancement phase towards the opened blank, an eventual non-operative phase, a second advancement phase, and a return phase; a movable assembly, supported rotatably the the said frame, carrying in the center a fixed folder member aligned with the line separating the two symmetrical flaps of the blank bilateral with respect to the first flap, in the closed position and supporting rotatably at each of its two extremities, a pin that carries eccentrically a corresponding folder arm; and drive, guide, locator and snap-in engagement means, all connected to the said assembly and defining for it an external position in which the relevant folder devices have no contact with the opened blank positioned in the container forming and filling station and, concurrently with the first advancement phase of the frame, an internal position of this in which the fixed folder member establishes contact with the second flap symmetrical with respect to the first flap, with a rotation of the said second flap through at least 90° towards the inside of the blank and, successively, the movement in counter-rotating directions of the said folder arms, with the remaining flaps being folded synchronously towards the inside of the blank until a predetermined minimum distance in between the said folder arms has been reached; the said drive, guide, locator and snap-in engagement means defining for the said assembly, concurrently with the second advancement phase of the frame, an intermediate position between the outside and the inside, with the said arms positioned at the minimum distance away one from the other, foreseen to limit the pressure applied on the respective flaps by the folder arms and the fixed folder member.

3. Apparatus according to claim 2, characterized in that the said drive means comprise: a shaft supported rotatably by the said frame and subjected to the said guide means; two bushes fixedly mounted on the said shaft, symmetrically with respect to the fixed folder member, each provided with a sector gear pointing in opposite directions; at least two sleeves, supported rotatably by the said shaft and carrying the aforementioned movable assembly, each of which engaging with a corresponding bush through the medium of the said snap-in means; and two bevel gears, each of which on the pin of a corresponding folder arm and meshing with a corresponding sector gear.

4. Apparatus according to claim 2 or 3, characterized in that the said locator means are constituted by two projections, of adjustable length, on the opposite sides of the movable assembly, destined to go flush up against corresponding walls of the movable frame and defining the aforementioned outside and inside positions of the said frame.

5. Apparatus according to claim 2 or 3, characterized in that the said snap-in means consist of at least one sleeve and one round movable projecting part subjected to elastic means and destined to be snap-in inserted in at least two housings made in the corresponding sector gear, on the opposite side to the teeth thereof, the said snap-in engagements defining the commencement of the rotation of the corresponding folder arm in one direction and the other, respectively.

6. Apparatus according to claim 2 or 3, wherein the means for transferring the container towards the movement devices of the banding group are constituted by the ends of the frames for the said first and second folding means, with these in an intermediate position between the extreme inner and outer positions.

7. Apparatus according to claim 2 or 3, charcterized in that the said guide means comprise: a first roller mounted idly on one extremity of the said shaft and destined to slide in a rectilineal guide, perpendicular to the motion of the said carriage, made in a longitudinal rod; and an arm, fixedly mounted on the said shaft in proximity of the said roller, on which idles a second roller destined to slide in a guide made in the form of a broken line and shaped, with respect to the direction in which the frame moves forward, with sections of decreasing and increasing distance, parallel with respect to the rectilineal guide, the first part of which being gone through in the first advancement phase of the frame, and the other parts in the second advancement phase of the said frame.

8. Apparatus according to claim 7, wherein the said longitudinal rod provided with the said guides is guided in a sliding fashion by transverse bars, further characteristics being that the said frame can be locked in a removable way to a transverse bar subjected to the said first drive means, that is guided in a sliding fashion by longitudinal bars parallel to the said longitudinal rod.

* * * * *